US009797684B2

(12) United States Patent
Mason et al.

(10) Patent No.: US 9,797,684 B2
(45) Date of Patent: Oct. 24, 2017

(54) ARCHERY SCOPE

(71) Applicant: Gregory E. Summers, Madison Heights, VA (US)

(72) Inventors: Tristan Mason, Madison Heights, VA (US); Gregory E. Summers, Amherst, VA (US)

(73) Assignee: Gregory E. Summers, Madison Heights, VA (US)

( * ) Notice: Subject to any disclaimer, the term of this patent is extended or adjusted under 35 U.S.C. 154(b) by 152 days.

(21) Appl. No.: 14/794,063

(22) Filed: Jul. 8, 2015

(65) Prior Publication Data

US 2017/0010069 A1 Jan. 12, 2017

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 33/265; 124/87
See application file for complete search history.

(56) References Cited

U.S. PATENT DOCUMENTS 4,928,394 A * 5/1990 Sherman ..... F41G 1/467 124/87
5,653,034 A * 8/1997 Bindon ..... G02B 23/105 33/297
5,924,234 A 7/1999 Bindon et al.
6,601,308 B2 8/2003 Khoshnood
7,082,690 B1 * 8/2006 Khoshnood ..... F41G 1/467 124/87
7,290,345 B2 * 11/2007 Ellig ..... F41G 1/467 124/87
7,578,067 B2 * 8/2009 Rager ..... F41G 1/467 124/87
7,603,784 B2 * 10/2009 Erhard ..... F41G 1/467 124/87
7,676,137 B2 3/2010 Schick et al.
7,739,825 B2 * 6/2010 LoRocco ..... F41G 1/02 33/265
7,814,669 B2 * 10/2010 Kingsbury ..... F41G 1/30 33/265
8,176,644 B1 5/2012 Summers
8,245,409 B2 * 8/2012 Varner ..... F41G 1/467 124/87
8,677,637 B2 * 3/2014 Willis ..... F41G 1/467 124/87

(Continued)

*Primary Examiner* — Christopher Fulton
(74) *Attorney, Agent, or Firm* — Leading Edge Law Group, PLC

(57) ABSTRACT

An archery scope includes a housing having a light receiving region arranged on an exterior surface of a cylindrical sight portion and at least one sight pin connected with the housing and arranged within the sight portion. At least one optical fiber extends through the sight pin and through the light receiving region to receive ambient light and deliver it to the end of the sight pin. The optical fiber is arranged on the exterior surface in a serpentine pattern to maximize the length of the fiber exposed to ambient light. A shield is rotatably connected with the housing sight portion for movement between open and closed positions to increase and decrease the amount of ambient light directed to the optical fiber, respectively, so that an archer can control the brightness of the sight pin.

12 Claims, 8 Drawing Sheets

(56) References Cited

U.S. PATENT DOCUMENTS

| | | | | |
|---|---|---|---|---|
| 8,713,807 | B2 * | 5/2014 | LoRocco | F41G 1/345<br>124/87 |
| 2013/0055618 | A1 * | 3/2013 | Watkins | F41G 1/38<br>42/123 |

* cited by examiner

ARCHERY SCOPE

BACKGROUND OF THE INVENTION

The present invention relates to an improved scope for attachment to a bow used in hunting and in tournament archery. More particularly, the invention relates to a scope including one or more sight pins and optical fibers which deliver ambient light to illuminate the pin. The improved scope enables the archer to adjust the degree of brightness of the sight pin.

BRIEF DESCRIPTION OF THE PRIOR ART

Archery scopes and sights are well known in the prior art as evidenced by the US patent to Khoshnood U.S. Pat. No. 6,601,308 which discloses a bow sight with an illuminated target pin or crosshair. A fiber optic filament is wound a number of times around the sight to collect ambient light and supply it via the filament to an end portion thereof which is attached to a pin or crosshair of the sight. The lit bow sight allows the hunter or archer to sight targets in low light environments.

The Summers et al U.S. Pat. No. 8,176,644 discloses an archery sight with an improved scope and sight pin arrangement in which the sight pins are adjustable.

While the prior devices operate satisfactorily, they do not allow an archer to adjust the brightness of the sight pin. The present invention was developed in order to overcome this and other drawbacks of the prior archery sights by providing an improved scope designed to fit the user's preferences and increase the accuracy of the archer.

SUMMARY OF THE INVENTION

Accordingly, it is a primary object of the invention to provide an archery scope including a housing having a light receiving region, at least one sight pin connected with the housing and at least one optical fiber extending within the light receiving region and through the sight pin. The optical fiber is arranged in a pattern within the light receiving region to maximize the exposure of the optical fiber to ambient light. According to a preferred embodiment, the fiber is arranged in a serpentine pattern within the light receiving region.

The housing includes a cylindrical sight portion which is open at both ends and has a longitudinal axis. The light receiving region is arranged on an exterior surface of the sight portion. The housing also includes an extended portion containing a chamber adjacent to the sight portion. The sight pin includes a sight end arranged within the sight portion and a second end arranged within the chamber. The optical fiber extends through the sight pin from the sight end to the second end, into the housing, and to the light receiving region.

A shield is slidably connected with the exterior surface of the housing sight portion to at least partially shield the optical fiber from ambient light. The shield is rotated by the archer to slide relative to the light receiving region between open and closed positions to increase and decrease the amount of light directed on the optical fiber, respectively, to adjust the brightness of the sight pin. The shield has a partial cylindrical configuration and is removably connected with the sight portion exterior surface via a snap-fit connection.

BRIEF DESCRIPTION OF THE FIGURES

Other objects and advantages of the invention will become apparent from a study of the following specification when viewed in the light of the accompanying drawing, in which.

DETAILED DESCRIPTION

Figure 8:
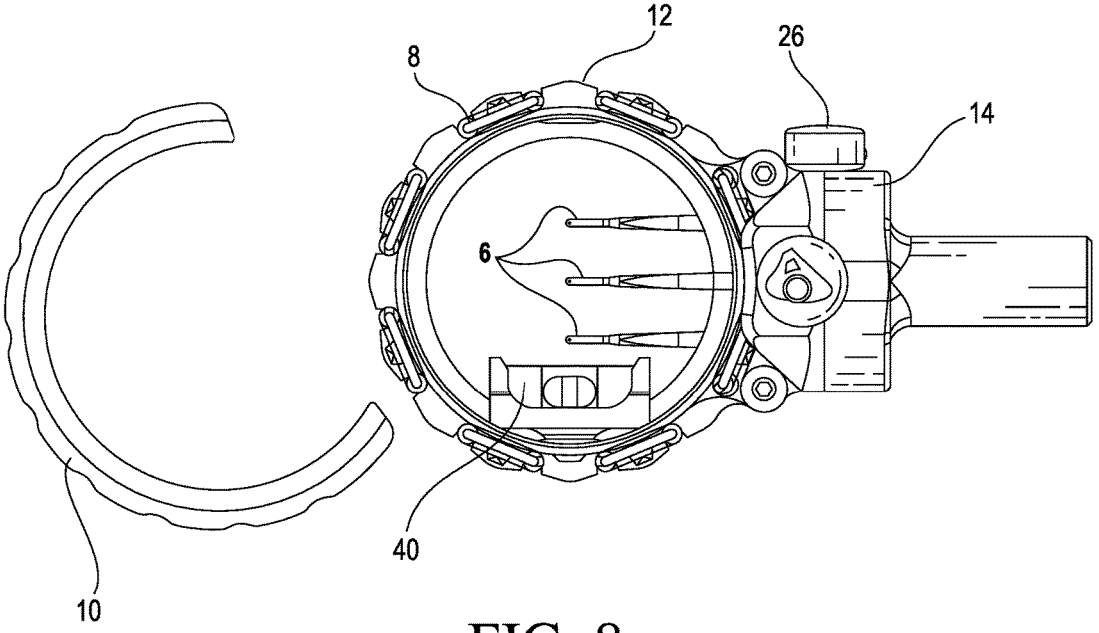
FIG. 8 is an exploded front view of the scope of FIG. 1 with the shield removed.

The archery scope 2 according to the invention is shown in an assembled condition in FIGS. 1-7 and in an exploded condition in FIG. 8. It includes a housing 4, one or more sight pins 6, and an optical fiber 8, best shown in FIG. 4. In a preferred embodiment, the scope also includes a shield 10 connected with the housing as will be developed in greater detail below.

Figure 11:
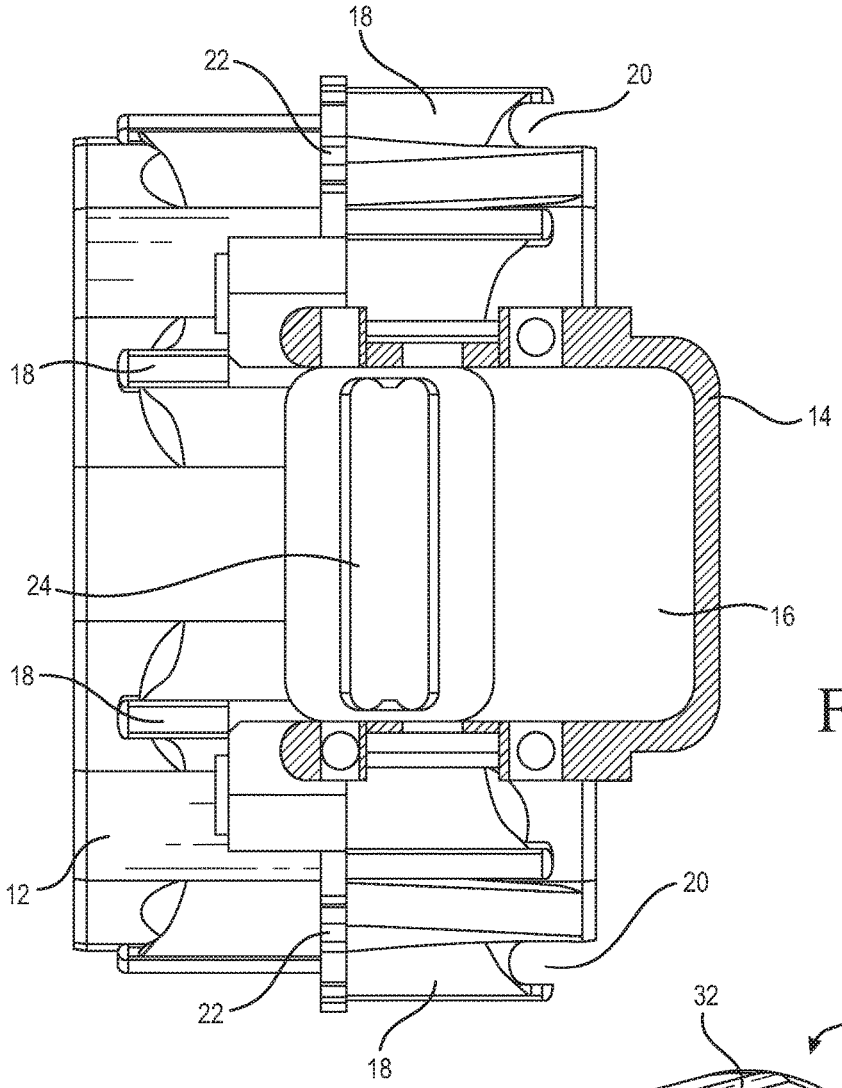
FIG. 11 is a sectional view of the housing extended portion taken along line 11-11 of FIG. 9.

The housing 4 includes a generally cylindrical sight portion 12 extending along a longitudinal axis and open at both ends. At one end, the housing further includes an extended portion 14 which contains a chamber 16 (FIG. 11).

Figure 4:
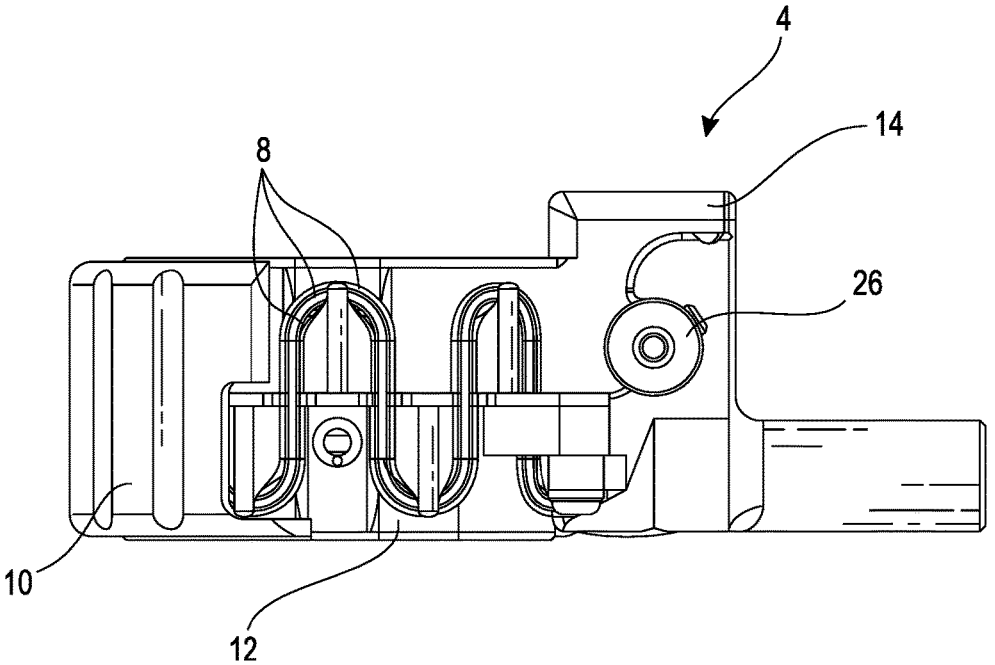
FIG. 4 is a top view of the scope of FIG. 1 showing the light receiving region.
Figure 5:
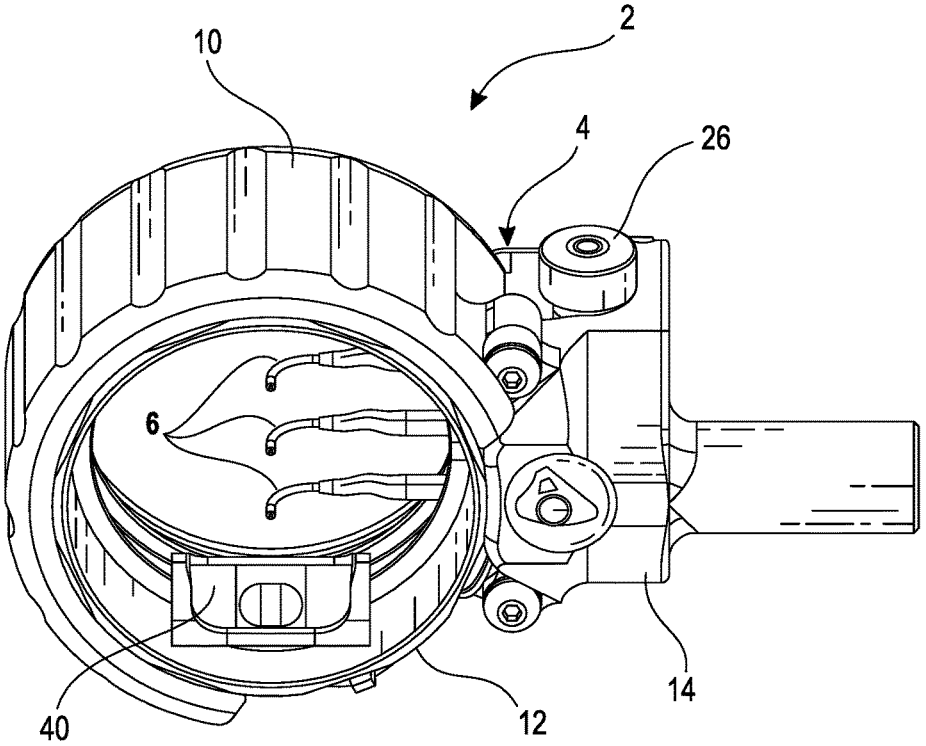
FIG. 5 is a front perspective view of the archery scope of FIG. 1 with the shield in the closed position.
Figure 6:
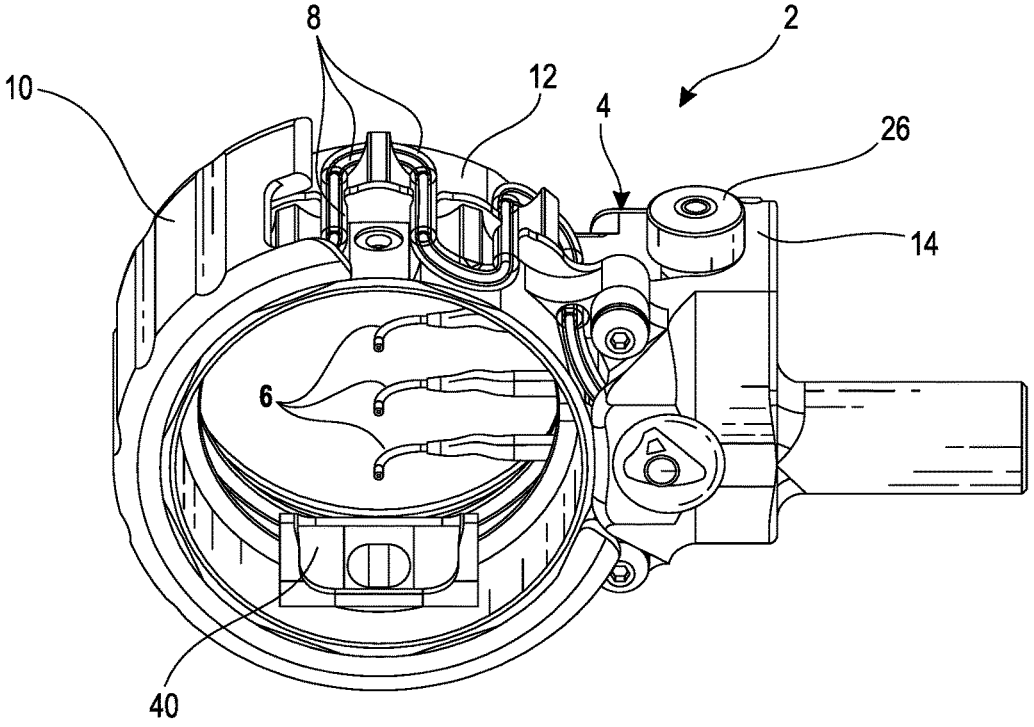
FIG. 6 is a front perspective view of the archery scope of FIG. 1 with the shield in the open position.
Figure 7:
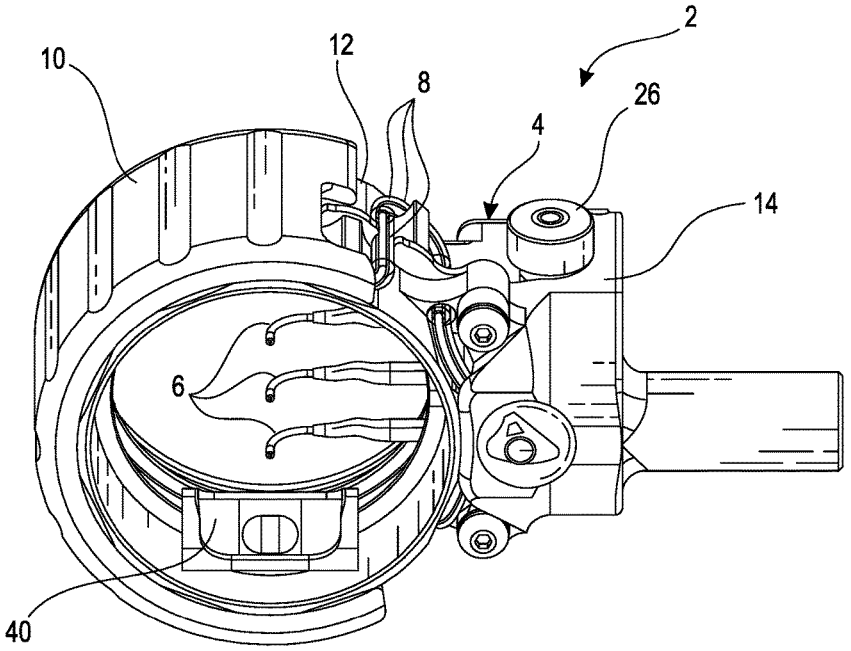
FIG. 7 is a front perspective view of the archery scope of FIG. 1 with the shield in a partially closed position.
Figure 9:
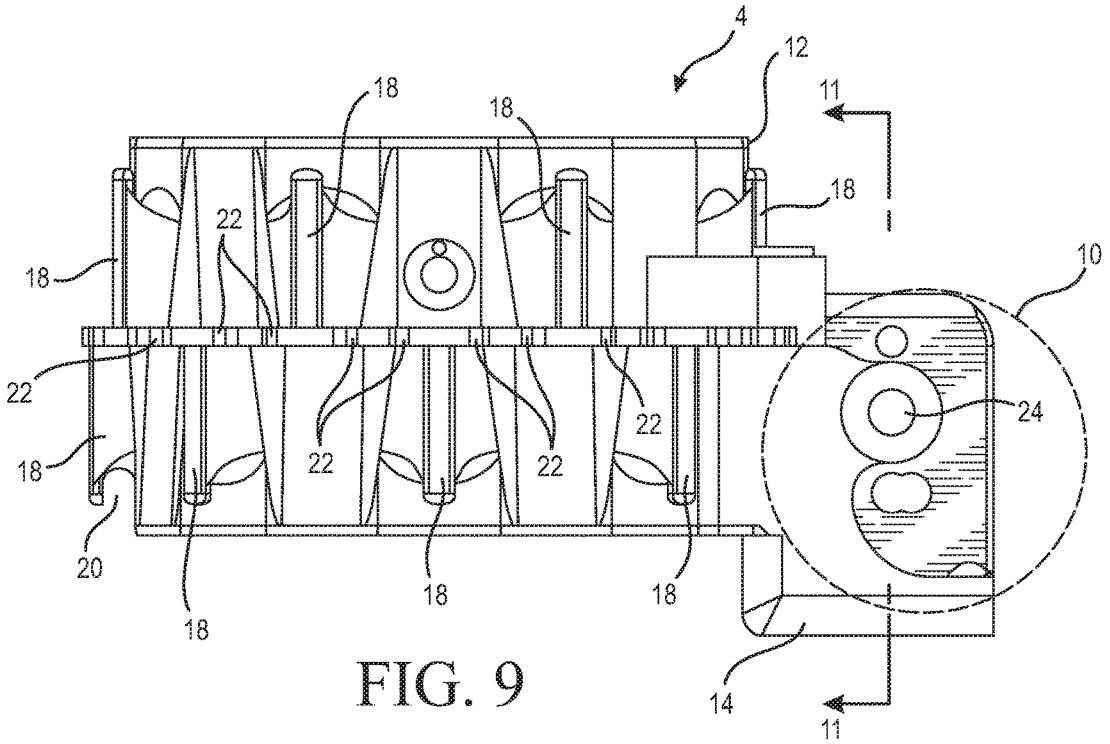
FIG. 9 is a detailed top view of the light receiving region of the scope of FIG. 1 with the shield and optical fiber removed.

The housing includes a light receiving region. Preferably, this region is on an exterior surface of the sight portion 12 as shown in FIG. 4. Extending through the light receiving region are one or more optical fibers 8 which are arranged to receive ambient light. There is one fiber for each sight pin. In the embodiment illustrated in the drawing figures, three sight pins are provided, but it is readily apparent to those of ordinary skill in the art that only one or a plurality of sight pins may be provided according to the needs of the archer. For three sight pins, three optical fibers are provided. Preferably, each fiber is of a different color. The fibers are preferably arranged in a pattern within the light receiving region. According to a preferred embodiment, the pattern is a zig-zag or serpentine pattern. The exterior surface of the sight portion includes projections 18 which extend from a medial portion of the exterior surface toward but short of the edge of the surface as shown more particularly in FIG. 9. At the end of each projection is a recess 20. Between adjacent projections are grooves 22. The optical fibers (which are not shown in FIG. 4 for clarity) are wound about the projections and arranged in the recesses 20 and grooves 22 so that the fibers are retained on the exterior surface of the sight portion in the predetermined pattern.

One end of each fiber terminates at a sight end of an associated sight pin 6. Each pin has a tubular configuration so that the fiber passes within the pin from the sight end and exits the pin at a second end of the pin within the chamber 16. Each fiber then passes through an opening in the housing to the light receiving region where the fiber is wound in a serpentine pattern on the exterior surface of the sight portion 12. After passing around the exterior of the sight portion, each fiber passes through an opening in the other side of the sight portion and terminates in the chamber 16 in the extended portion 14 of the housing. Though each fiber extends only once around the cylindrical sight portion, the amount of ambient light to which each fiber is exposed is maximized owing to the serpentine pattern with which the fiber is arranged on the sight portion exterior surface.

Figure 10:
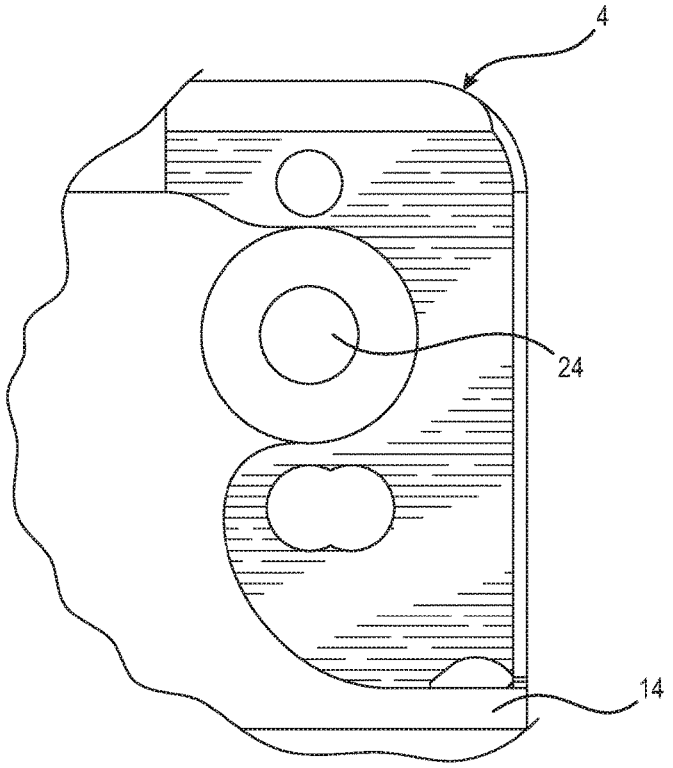
FIG. 10 is a detailed view of the extended portion of the housing of the scope of FIG. 1 taken within region 10 of FIG. 9.

The sight pins 6 are adjustable within the housing sight portion in a manner described in U.S. Pat. No. 8,176,644 which is incorporated herein by reference. To that end, the housing extended portion 14 contains a lateral opening 24 (FIG. 10) in which a threaded screw is arranged for rotation. The sight pins are mounted on the threaded portion of the screw. At the end of the screw is a knob 26 which is rotated by the archer to displace the pins relative to the threaded portion of the screw. Excess slack of the optical fibers 8 is provided within the chamber to accommodate the displacement of each sight pin during adjustment thereof.

Figure 12:
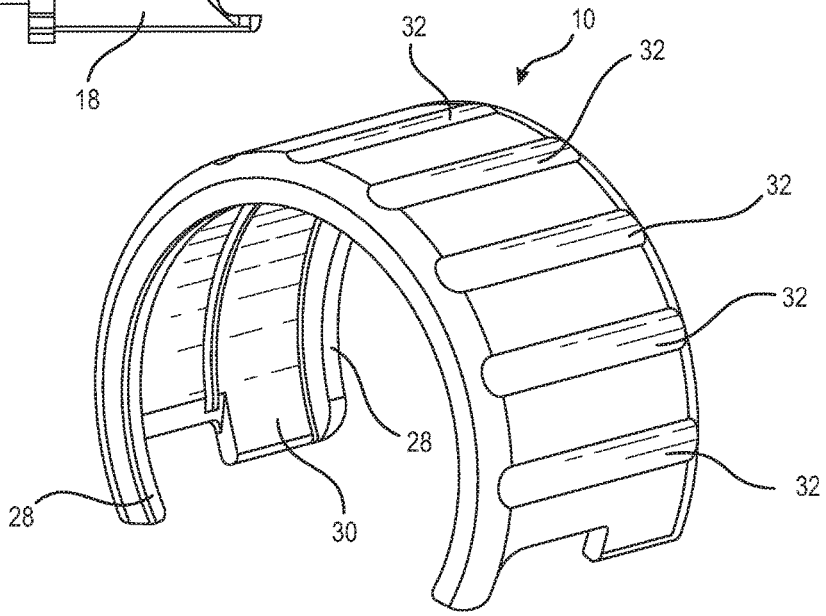
FIG. 12 is a perspective view of the shield for the scope of FIG. 1.
Figure 13:
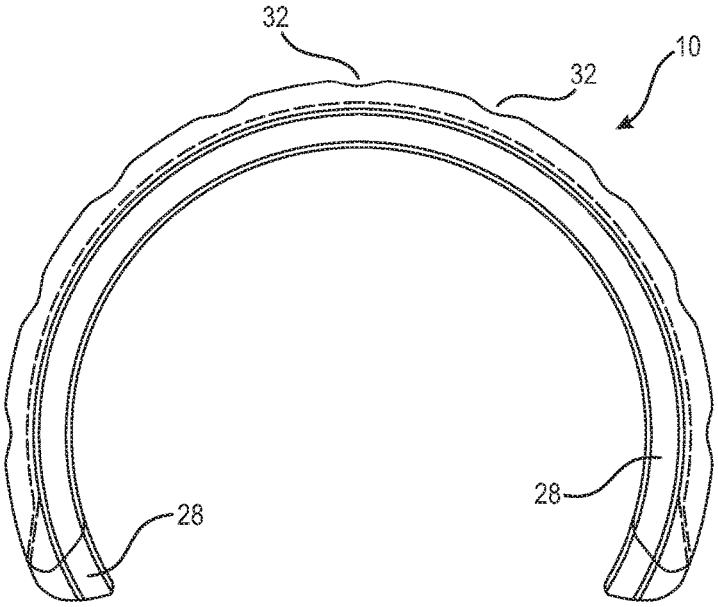
FIGS. 13 and 14 are front and bottom views, respectively, of the shield of FIG. 12.
Figure 14:
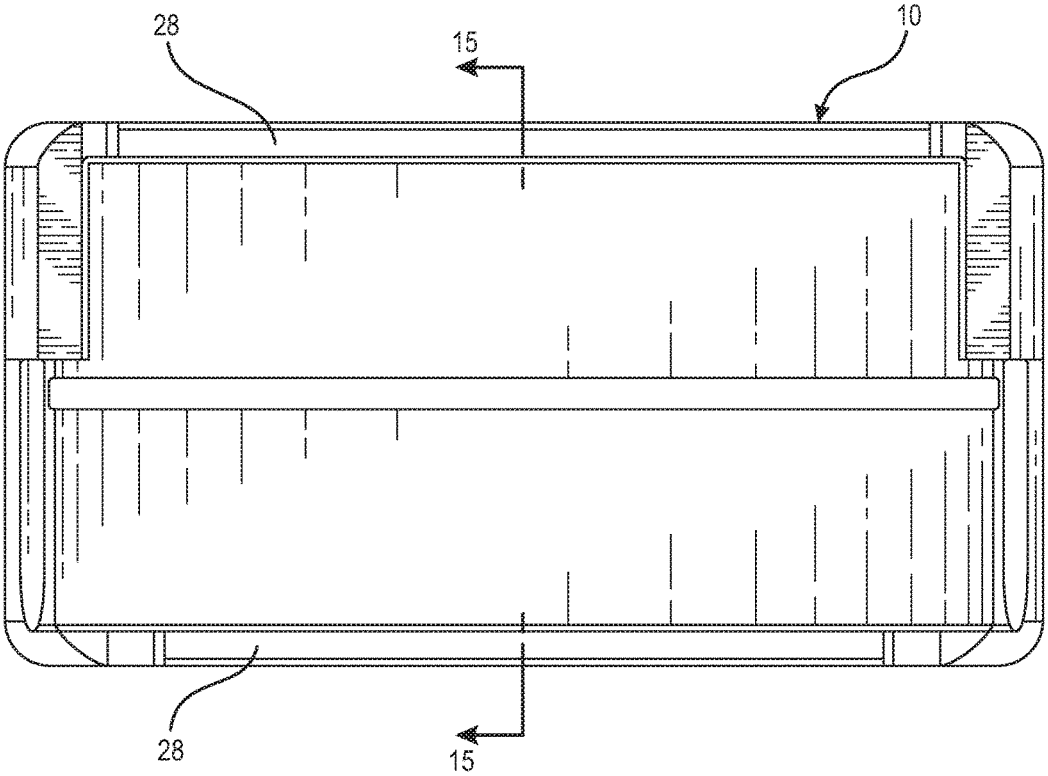
Figure 15:
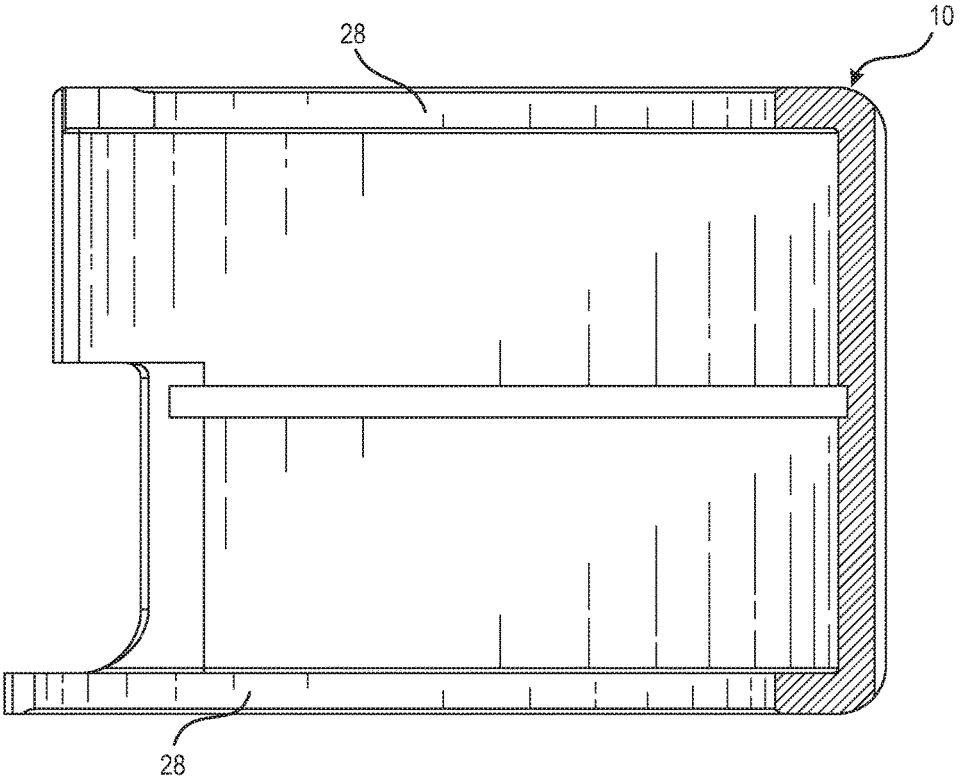
FIG. 15 is a sectional view of the shield taken along line 15-15 of FIG. 14.

Turning now to FIGS. 12-15, the shield 10 will be described in greater detail. It is formed of a material, preferably opaque, which is rigid and yet has a limited degree of flexure. A suitable material is a synthetic plastic. As shown in FIG. 12, the shield has a partial cylindrical configuration. It is designed for removable connection with the housing sight portion outer surface via a snap-fit connection. Accordingly, for maximum exposure of the optical fibers to ambient light, the shield may be removed from the housing. When connected with the housing sight portion, the shield is coaxial with the sight portion.

The shield includes lips 28 which project from the outer edges thereof a sufficient distance to define an internal channel 30 which houses or encloses the projections 18 on the outer surface of the housing sight portion 12 as well as the optical fibers arranged about the outer surface when the shield is connected with the housing sight portion. The exterior surface of the shield includes a plurality of spaced parallel grooves 32 which provide a gripping surface for the archer. When the shield is connected with the housing sight portion outer surface, the shield is slidable relative to the outer surface. That is, it is rotatable about the longitudinal axis of the sight portion for sliding movement relative to the housing sight portion between the closed position shown in FIG. 5 and the open position shown in FIG. 6.

When in the closed position, the shield 10 covers the optical fibers in the upper or top portion of the light receiving region of the housing sight portion to block ambient light from impacting the fibers in this region. Only the fibers in the lower or bottom portion of the light receiving region are exposed, but the exposure in this region is more limited when the scope is in use since the scope also blocks a high degree of ambient light. When the shield is rotated by the user to the open position shown in FIG. 6, the optical fibers in the upper portion of the light receiving region are exposed and thus are able to receive a greater amount of ambient light. The greater exposure to ambient light increases the brightness of the sight pin ends. Rotating the shield from the open position toward the closed position decreases the ambient light directed on the optical fibers, thereby gradually reducing the brightness of the sight pins. Accordingly, the archer can adjust the degree of brightness by positioning the shield at any location between the open and closed positions.

Figure 16:
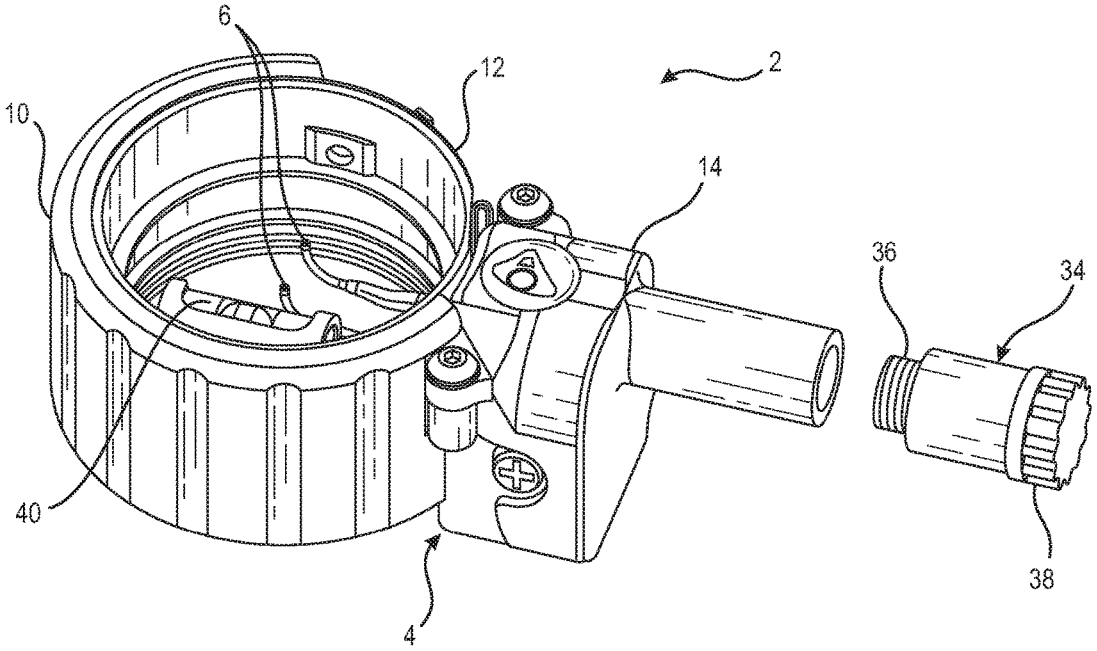
FIG. 16 is an exploded perspective view of an alternate embodiment of a scope including an auxiliary light according to the invention.

In certain conditions, there is insufficient ambient light to illuminate the sight pin ends. In such situations, the fibers may be illuminated by an auxiliary light assembly 34 which can be connected with the tubular end of the housing extended portion 14 as shown in FIG. 16. In the embodiment shown, one end of the light assembly includes threads 36 which mate with threads in the interior of the tubular portion. The other end of the light assembly includes a switch 38 to operate the light. Light from the light assembly is directed from the threaded end into the chamber 14 to illuminate the free ends of the optical fibers arranged in the chamber.

Figure 1:
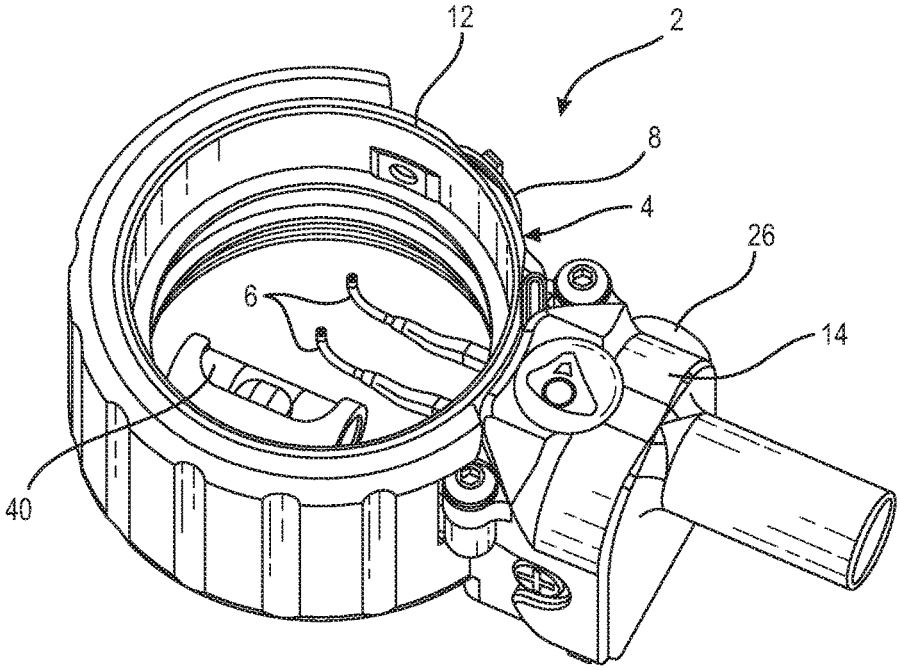
FIG. 1 is a perspective view of the archery scope according to a preferred embodiment of the invention.
Figure 2:
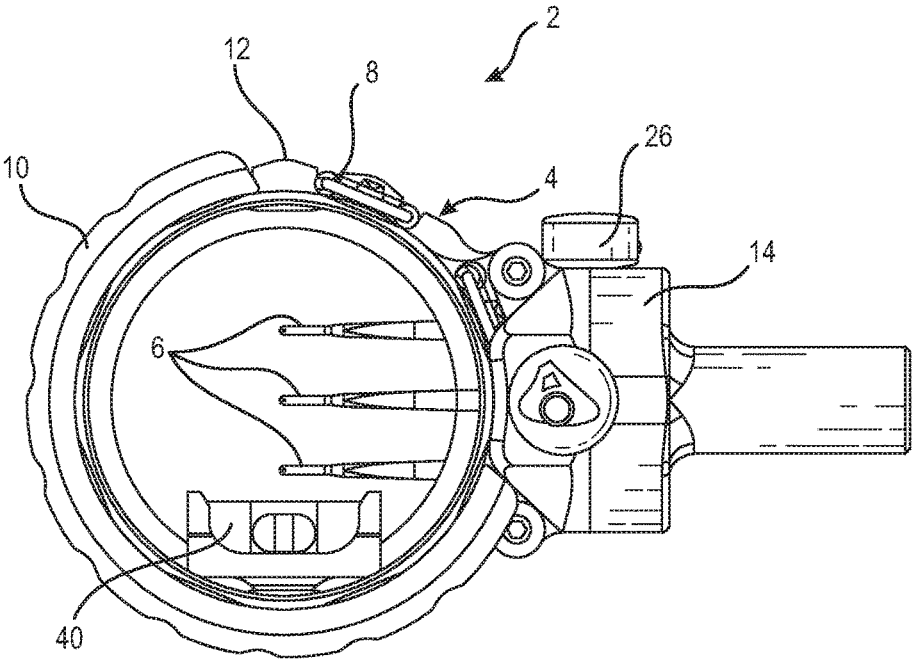
FIG. 2 is a front view of the scope of FIG. 1.
Figure 3:
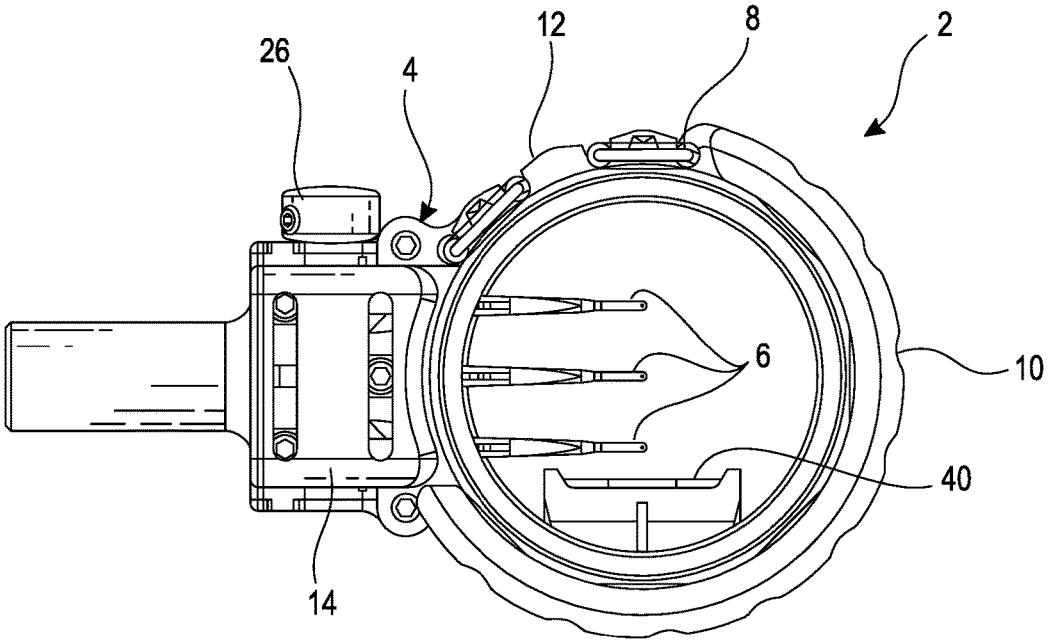
FIG. 3 is a rear view of the scope of FIG. 1.

The scope according to the invention may include other features as are known in the art. For example, a level indicator 40 may be connected with the inner surface of the housing sight portion to assist the archer with leveling a bow. In the views of FIGS. 1 and 16, the level indicator hides one of the three sight pins.

The housing and sight pins are formed of any durable rigid lightweight material such as metal or synthetic plastic. A preferred metal for the housing is aluminum because of its light weight and durability. The housing, sight pins, shield and light assembly are all preferably formed, plated or painted in the same color.

While the preferred forms and embodiments of the invention have been illustrated and described, it will become apparent to those of ordinary skill in the art that various changes and modifications may be made without deviating from the inventive concepts set forth above.

What is claimed is:

1. An archery scope, comprising (a) a housing that includes a cylindrical sight portion having a longitudinal axis and an exterior surface containing a light receiving region;

(b) at least one sight pin connected with said housing;

(c) at least one optical fiber extending within said light receiving region and extending through said sight pin, said optical fiber being arranged in a uniform serpentine pattern within said light receiving region along said exterior surface and extending between edges of said exterior surface equidistant from and coaxial with said longitudinal axis to maximize the exposure of said optical fiber to ambient light.

2. An archery scope as defined in claim 1, wherein said housing contains a chamber adjacent to said sight portion and said sight pin includes a sight end arranged within said sight portion and a second end arranged within said housing chamber, said optical fiber extending through said sight pin from said sight end to said second end, into said housing, and to said light receiving region.

3. An archery scope as defined in claim 2, wherein said at least one sight pin is adjustably connected with said housing and an excess portion of said optical fiber is arranged within said housing chamber to provide slack in said optical fiber to accommodate movement of said at least one sight pin.

4. An archery scope as defined in claim 3, and further comprising a light source connected with said housing and arranged in said chamber to provide additional light to said optical fiber.

5. An archery scope, comprising (a) a cylindrical housing having a longitudinal axis and an exterior surface that includes a light receiving region;

(b) at least one sight pin connected with said housing;

(c) at least one optical fiber extending within said light receiving region and through said sight pin, said optical fiber being arranged in a serpentine pattern within said light receiving region along said exterior surface and extending between edges of said exterior surface equidistant from and coaxial with said longitudinal axis to maximize the exposure of said optical fiber to ambient light; and (d) a shield connected with said housing light receiving region to at least partially shield said optical fiber from ambient light.

6. An archery scope as defined in claim 5, wherein said shield is slidably connected with said housing light receiving region for displacement between open and closed positions, whereby an archer can displace said shield to said open position to increase the amount of light directed on said optical fiber and to said closed position to decrease the amount of light directed on said optical fiber, thereby to adjust the brightness of the sight pin.

7. An archery scope as defined in claim 6, wherein said shield is removably connected with said housing light receiving region.

8. An archery scope, comprising (a) a housing that includes a cylindrical sight portion and a light receiving region arranged on an exterior surface of said cylindrical sight portion;

(b) at least one sight pin connected with said housing;

(c) at least one optical fiber extending within said light receiving region and extending through said sight pin; and (d) a shield having a partial cylindrical configuration and being removably connected with said housing sight portion exterior surface via a snap-fit connection to at least partially shield said light receiving region and said optical fiber from ambient light.

9. An archery scope as defined in claim 8, wherein said shield is slidably connected with said cylindrical sight exterior surface for displacement between open and closed positions, whereby an archer can displace said shield to said open position to increase the amount of light directed on said optical fiber and to said closed position to decrease the amount of light directed on said optical fiber, thereby to adjust the brightness of the sight pin.

10. An archery scope as defined in claim 8, wherein said shield is formed of a material which affords flexure from said cylindrical configuration.

11. An archery scope as defined in claim 10, wherein said shield is rotatable relative to said sight portion exterior surface, said shield being coaxial with said sight portion.

12. An archery scope as defined in claim 10, wherein said shield is formed of an opaque material.

* * * * *